US009121153B2

(12) United States Patent
Bishop

(10) Patent No.: US 9,121,153 B2
(45) **Date of Patent: *Sep. 1, 2015**

(54) MARINE BARRIER GATE

(71) Applicant: HALO Maritime Defense Systems, Inc., Newton, NH (US)

(72) Inventor: Justin Bishop, Newton, NH (US)

(73) Assignee: Haol Maritime Defense Systems, Newton, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/261,242

(22) Filed: Apr. 24, 2014

(65) Prior Publication Data

US 2014/0231734 A1 Aug. 21, 2014

Related U.S. Application Data

(63) Continuation of application No. 13/598,353, filed on Aug. 29, 2012, now Pat. No. 8,739,725.

(60) Provisional application No. 61/573,099, filed on Sep. 1, 2011, provisional application No. 61/628,620, filed on Nov. 3, 2011.

(51) Int. Cl.
*F41H 11/05* (2006.01)
*E02B 3/04* (2006.01)
(Continued)

(52) U.S. Cl.
CPC ... *E02B 3/04* (2013.01); *B63G 9/04* (2013.01); *E02B 7/20* (2013.01)

(58) Field of Classification Search
CPC ..... F41H 11/05; B63G 9/04; E02B 3/04; E02B 3/062; E02B 7/20
USPC ..... 405/21, 60, 211, 212; 114/241, 240 R, 114/240 A, 240 B, 240 E; 256/13.1
See application file for complete search history.

(56) References Cited

U.S. PATENT DOCUMENTS 2,693,161 A 11/1954 Stubbs
3,499,291 A 3/1970 Mikkelsen
(Continued)

FOREIGN PATENT DOCUMENTS

WO 02/26019 4/2002
WO 2008-144534 11/2008
WO 2011-005112 1/2011

OTHER PUBLICATIONS

International Search Report and Written Opinion issued in International Patent Application No. PCT/US2012/053094 mailed Nov. 20, 2012.

(Continued)

*Primary Examiner* — Benjamin Fiorello
(74) *Attorney, Agent, or Firm* — Miles & Stockbridge P.C.; Michael A. Messina

(57) ABSTRACT

A marine barrier gate includes a pleated row of buoyant panels movable between an expanded position where the panels have an angle therebetween, and a retracted position where the panels are substantially parallel. A first buoy is attached to a first end of the panel row, and a second buoy is remote from the panels when the panels are in the retracted position. The second buoy has a tow winch and cable attached to a second end opposite the first end, for moving the panels from the retracted position to the expanded position. The first buoy comprises a catenary winch and cable movably engagable with the panels and attached to the second buoy. When the panels are in the retracted position, the catenary winch sets a length or tension of the catenary cable such that it absorbs catenary loads on the barrier when the panels are moved to the expanded position by the tow winch.

34 Claims, 20 Drawing Sheets

(51) Int. Cl.
*B63G 9/04* (2006.01)
*E02B 7/20* (2006.01)

(56) References Cited

U.S. PATENT DOCUMENTS

| | | | |
|---|---|---|---|
| 3,604,389 | A | 9/1971 | Roberts |
| 3,823,680 | A | 7/1974 | Straumsnes |
| 3,864,049 | A | 2/1975 | Ono |
| 4,033,137 | A | 7/1977 | Geist |
| 4,174,185 | A | 11/1979 | Toki |
| 4,272,214 | A | 6/1981 | Nyfeldt |
| 4,319,858 | A | 3/1982 | Jaffrennou |
| 4,425,053 | A | 1/1984 | Muto |
| 4,484,836 | A | 11/1984 | Bailard |
| 4,681,302 | A | 7/1987 | Thompson |
| 5,062,739 | A | 11/1991 | Klockner |
| 5,141,359 | A | 8/1992 | Klockner |
| 5,429,452 | A | 7/1995 | Frost |
| 5,651,709 | A | 7/1997 | Nandakumar |
| 5,827,011 | A | 10/1998 | Kann |
| 6,102,616 | A | 8/2000 | Foote |
| 6,591,774 | B2 | 7/2003 | Metherell |
| 6,655,641 | B2 | 12/2003 | Sherman |
| 6,843,197 | B1 | 1/2005 | Nixon |
| 6,860,209 | B2 | 3/2005 | McKoy |
| 6,877,456 | B2 | 4/2005 | Metherell |
| 6,886,484 | B2 | 5/2005 | Thomas |
| 6,960,047 | B2 | 11/2005 | Knezek |
| 6,980,483 | B2 | 12/2005 | McDonald |
| 7,140,599 | B1 | 11/2006 | Spink |
| 7,351,008 | B2 | 4/2008 | Yodock |
| 7,401,565 | B2 | 7/2008 | Nixon |
| 7,451,527 | B2 | 11/2008 | Pearce |
| 7,481,176 | B2 | 1/2009 | Pratt |
| 7,524,139 | B2 | 4/2009 | Bishop |
| 7,524,140 | B2 | 4/2009 | Bishop |
| 7,572,083 | B1 | 8/2009 | Bishop |
| 7,726,910 | B2 | 6/2010 | Foo |
| 7,744,313 | B2 | 6/2010 | Terai |
| 7,862,258 | B2 | 1/2011 | Meyers |
| 7,887,254 | B2 | 2/2011 | Bishop |
| 7,975,639 | B2 | 7/2011 | Bishop |
| 8,007,202 | B2 | 8/2011 | Davis |
| 8,020,836 | B2 | 9/2011 | Bishop |
| 2003/0190191 | A1 | 10/2003 | Clark |
| 2004/0018055 | A1 | 1/2004 | Clark |
| 2004/0018060 | A1 | 1/2004 | Knezek |
| 2004/0115002 | A1 | 6/2004 | Meeks |
| 2005/0013668 | A1 | 1/2005 | Nixon |
| 2005/0058509 | A1 | 3/2005 | Steinberg |
| 2006/0034668 | A1 | 2/2006 | Knezek |
| 2006/0037526 | A1 | 2/2006 | Knezek |
| 2008/0105184 | A1 | 5/2008 | Nixon |
| 2008/0279631 | A1 | 11/2008 | Bishop |
| 2009/0090059 | A1 | 4/2009 | Bishop |
| 2010/0059728 | A1 | 3/2010 | Bishop |
| 2010/0178109 | A1 | 7/2010 | Wilson |
| 2013/0108368 | A1 | 5/2013 | Bishop |
| 2013/0119334 | A1 | 5/2013 | Bishop |

OTHER PUBLICATIONS

International Search Report and Written Opinion issued in International Patent Application No. PCT/US2012/052655 mailed Nov. 6, 2012.

Chinese Office Action for CN 201280053422.4 dated Nov. 3, 2014 with English translation.

International Preliminary Report issued in Patent Application PCT/2012/053094 mailed Mar. 4, 2014.

International Preliminary Report issued in Patent Application PCT/2012/052655 mailed Mar. 4, 2014.

Extended European Search Report for EP Application No. 12827576.5 dated Apr. 5, 2015.

Second Chinese Office Action for CN201280053422.4 dated Jun. 30, 2015 with English Translation.

MARINE BARRIER GATE

RELATED APPLICATIONS

This application is a continuation of U.S. patent application Ser. No. 13/598,353, filed Aug. 29, 2012, now U.S. Pat. No. 8,739,725, which claims the benefit o f U.S. Provisional Application No. 61/573,099, filed Sep. 1, 2011, entitled "Rapidly Deployed Marine Barrier and Gate," and U.S. Provisional Application No. 61/628,620, filed Nov. 4, 2011, entitled "Guardian Gate," the disclosures of which are entirely incorporated herein by reference.

TECHNICAL FIELD

The present subject matter relates to floating marine structures. The disclosed techniques and equipment have particular applicability to floating structures that need to be repeatedly moved from one position to another, such as barriers, gates, etc.

BACKGROUND

Certain marine structures such as security barriers and other floating structures need to be repeatedly moved from one position to another. An example is a gate for a fully enclosed military port or harbor, which must be moved from an open position to a closed position and back again.

Current practice for moving barrier gates, etc. is to make connections at the ends of unit structures, or at the ends of a series of end-to-end linked unit structures. Using these conventional techniques, the structure forms a catenary shape as the forces of wind and current push the floating links into a curved condition, as the ends are the only restraints to these forces. In practice, the connections at these ends carry the forces needed to pull the entire structure taut from end to end, while the forces of current, wind and waves can be broadside to the structure. This can result in a substantial force making closure difficult and requiring latching systems to carry both the forces of loads from wind and waves on the structure, as well as operational forces of fluid drag and moving the mass of the marine structure itself.

Another disadvantage of current techniques for moving marine gates or booms is that they require vessels and personnel to physically do the work of moving the structures, and of latching or connecting the ends of the linked structures to their fixed locations. Those vessels and personnel can mishandle the transit, wandering into navigation channels and sometimes causing marine barriers to flip over. Such equipment and personnel is also vulnerable to attack while moving the structures. The result is high labor and equipment costs, and danger to personnel.

Hence a need exists for a safer, less costly, and more reliable way of repeatedly moving floating and submerged marine structures.

SUMMARY

The concepts disclosed herein alleviate the above noted problems with conventional practices. An advantage of the disclosed marine barrier gate is that it separates environmental loads of wind, waves, and currents from the operational loads of opening and closing the gate, which significantly eases the operational task of moving such marine gates and barriers between mooring buoys or fixed structures. The disclosed apparatus transfers the environmental forces that act on a marine gate to a separate catenary cable, so the closure and latching forces result primarily from the movement of the marine gate in the water along the cable path. Moreover, the disclosed apparatus enables automation and remote operation of the gate to be safely conducted, as the gate remains tethered to a cable. Thus, the marine gate(s) can be moved by winching, by an attached head vehicle, or both, potentially saving considerable standby labor costs and injuries from manually making latch connections at sea.

According to the present disclosure, a marine barrier gate comprises a first plurality of substantially vertical panels, each of the panels having a buoyant bottom portion and a pair of opposing sides; and a plurality of hinges, each hinge for moveably connecting a side of a first one of the panels to a side of an adjacent second one of the panels with an included angle therebetween, to form a buoyant continuous first pleated row of panels, such that the hinges are arranged in first and second substantially parallel rows. When the first row of panels is floating in a body of water, the panels are movable between an expanded position where adjacent ones of the panels are disposed with the included angle therebetween, and a retracted position where the panels are substantially parallel to each other. The marine barrier gate further comprises a substantially stationary first buoy attached to a first end hinge of the second row of hinges; and a substantially stationary second buoy disposed remote from the panels when the panels are in the retracted position. The second buoy has a first tow winch with a first tow cable extendible to, and attachable to, a second end hinge of the second row of hinges opposite the first end hinge, for moving the panels from the retracted position to the expanded position by operation of the first tow winch. The first buoy comprises a catenary winch with a catenary cable movably engagable with the first pleated row of panels and extendible and attachable to the second buoy. When the first row of panels is in the retracted position, and the first tow cable is attached to the second end hinge of the second row of hinges, and the catenary cable is attached to the second buoy, the catenary winch is for setting a length or tension of the catenary cable such that the catenary cable absorbs catenary loads on the barrier when the panels are moved from the retracted position to the expanded position by operation of the first tow winch.

According to another aspect of the present disclosure, the first buoy has a second tow winch with a second tow cable passing through the hinges of the second row of hinges and attached to the second end hinge of the second row of hinges, for moving the panels from the expanded position to the retracted position by operation of the second tow winch. When the first row of panels is in the expanded position, and the first tow cable is detached from the second end hinge of the second row of hinges, and the catenary cable is attached to the second buoy, the catenary winch is for setting a length or tension of the catenary cable such that the catenary cable absorbs catenary loads on the barrier when the panels are moved from the expanded position to the retracted position by operation of the second tow winch.

According to a further aspect of the present disclosure, the first tow cable is fixedly attached to the second end hinge of the second row of hinges, and is extendible by the first tow winch to a position below a surface of the body of water when the first row of panels is in the retracted position; and the catenary cable is fixedly attached to the second buoy, and is extendible by the catenary winch to a position below a surface of the body of water when the first row of panels is in the retracted position.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The disclosed apparatus allows a floating marine structure(s), such as a marine barrier gate, to be moved along a cable system where environmental loads of wind, waves, and currents are borne by a catenary cable, and the operational loads of opening and closing the gate are handled by separate tow cables. The apparatus is ideal for repeatedly moving floating gates into open or closed positions. It allows vessels to pass over submerged parts of the system when the floating structures have been moved out of the way using the disclosed apparatus. Generally, the movement of the apparatus is aligned with the longitudinal axis of the floating gate being moved.

An important advantage of the disclosed apparatus is that it enables the separation of environmental loads of wind, waves and currents from operational loads of moving marine structures from point to point, significantly easing the operational task of moving marine gates and barriers between mooring buoys or fixed structures.

In certain embodiments, the disclosed apparatus maintains a continuous connection between the marine structures and the components of the apparatus (e.g., cables) along which the structures travel. This enables safer, simpler automation and remote control, as the marine structures are never released from the apparatus, and the movement of the marine structures always follows a cable, therefore approaching end positions consistently via a controlled path.

Reference now is made in detail to the examples illustrated in the accompanying drawings and discussed below.

Figure 1A:
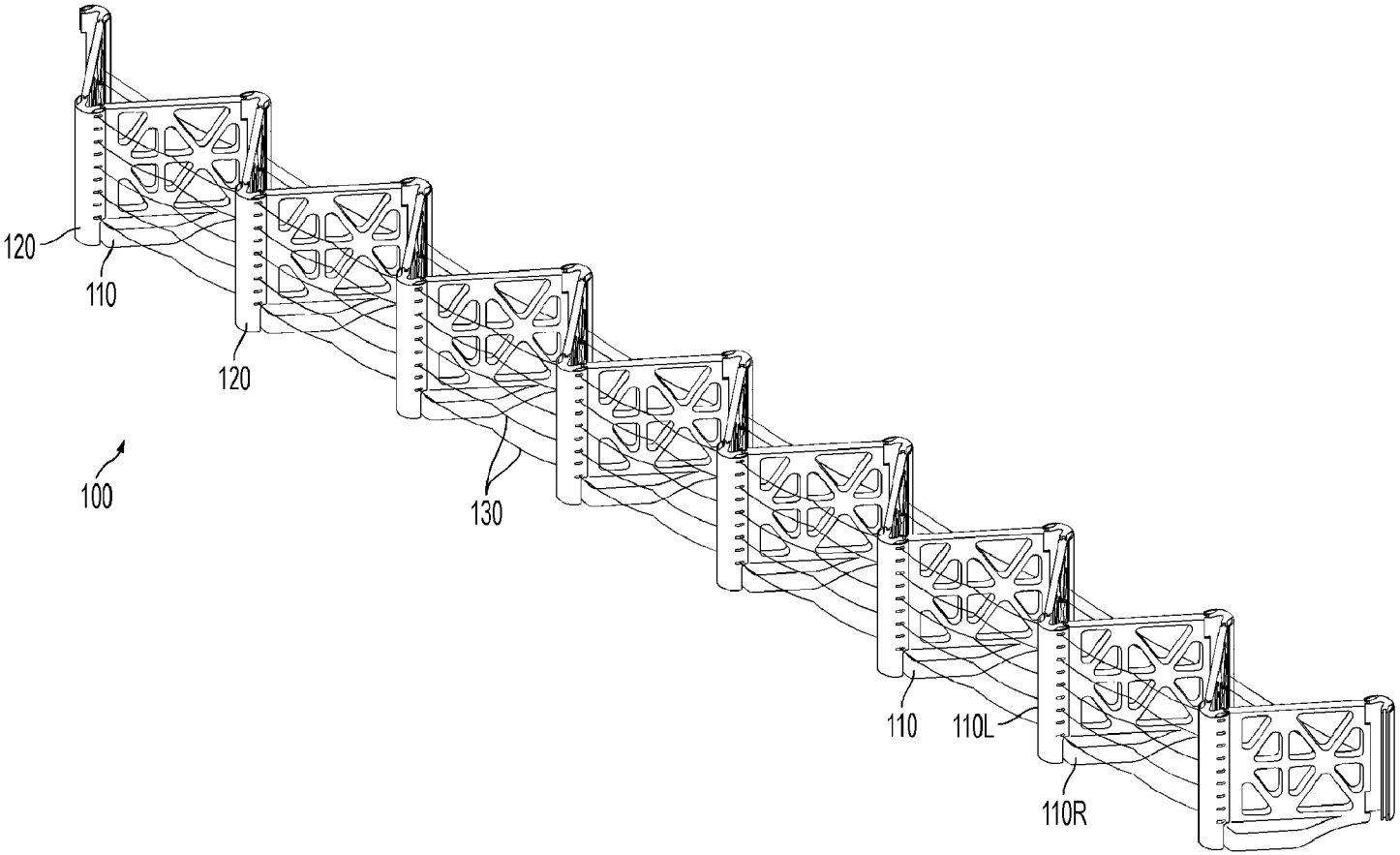
FIG. 1A is a perspective view of a marine barrier usable in embodiments of the disclosed marine barrier gate.
Figure 1B:
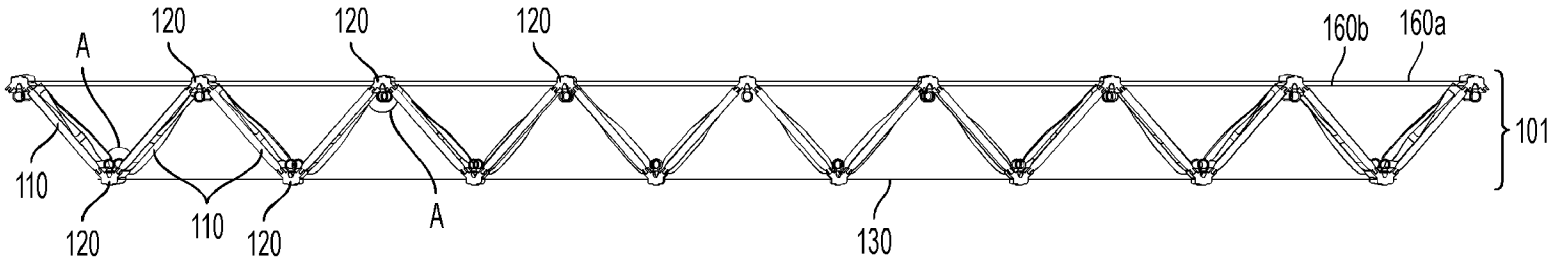
FIGS. 1B and 1C are top views of the barrier of FIG. 1A.
Figure 1C:
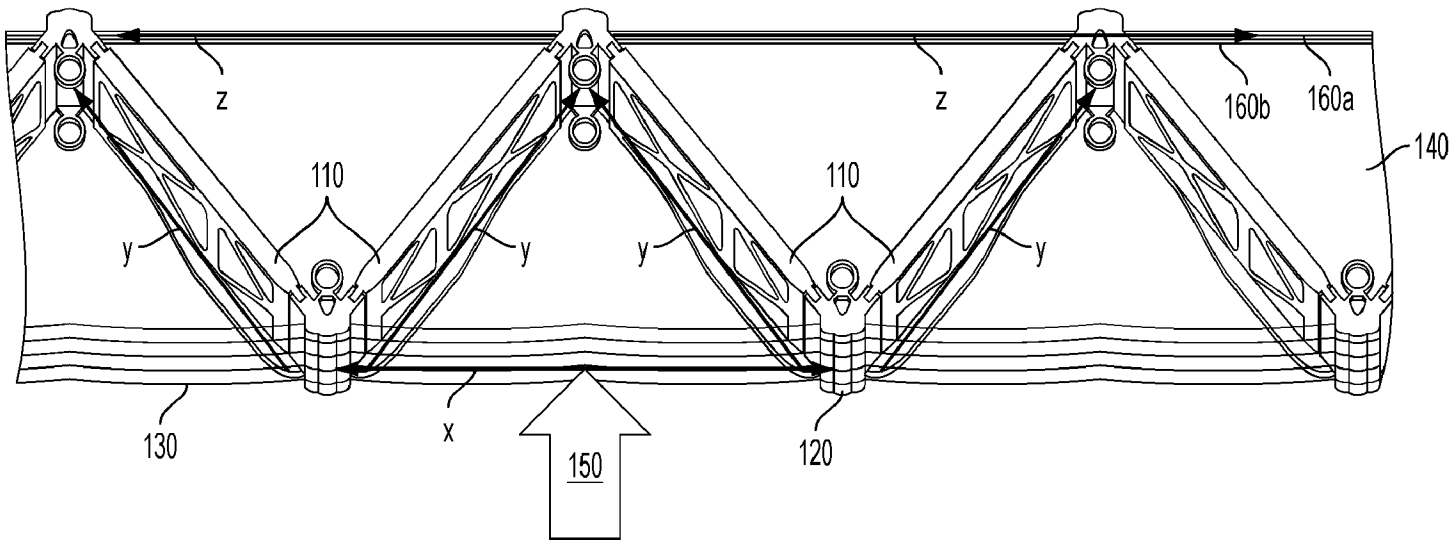
Figure 2A:
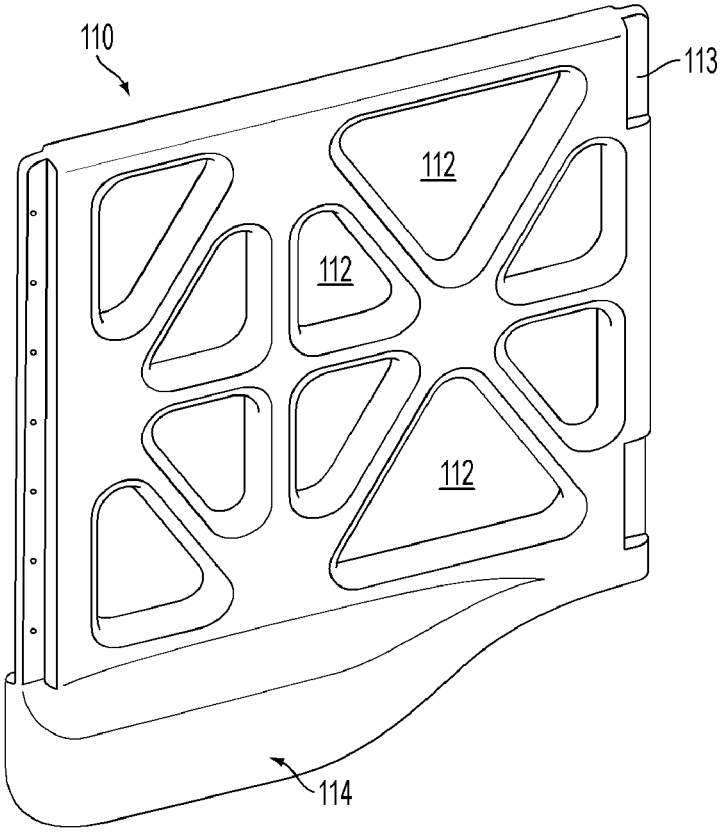
FIGS. 2A-C are views of buoyant panels usable in embodiments of the disclosed marine barrier gate.
Figure 2B:
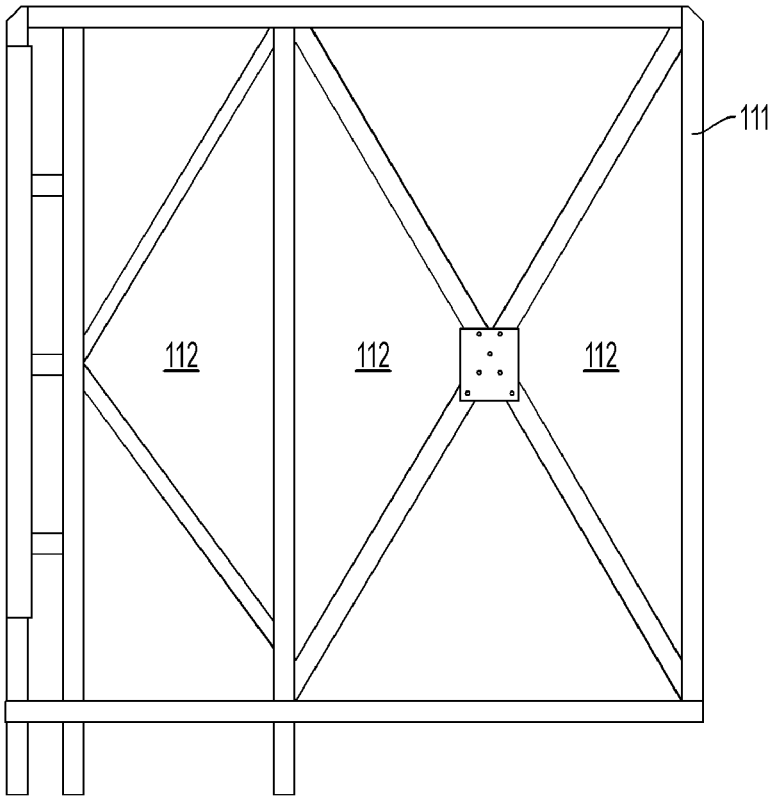
Figure 2C:
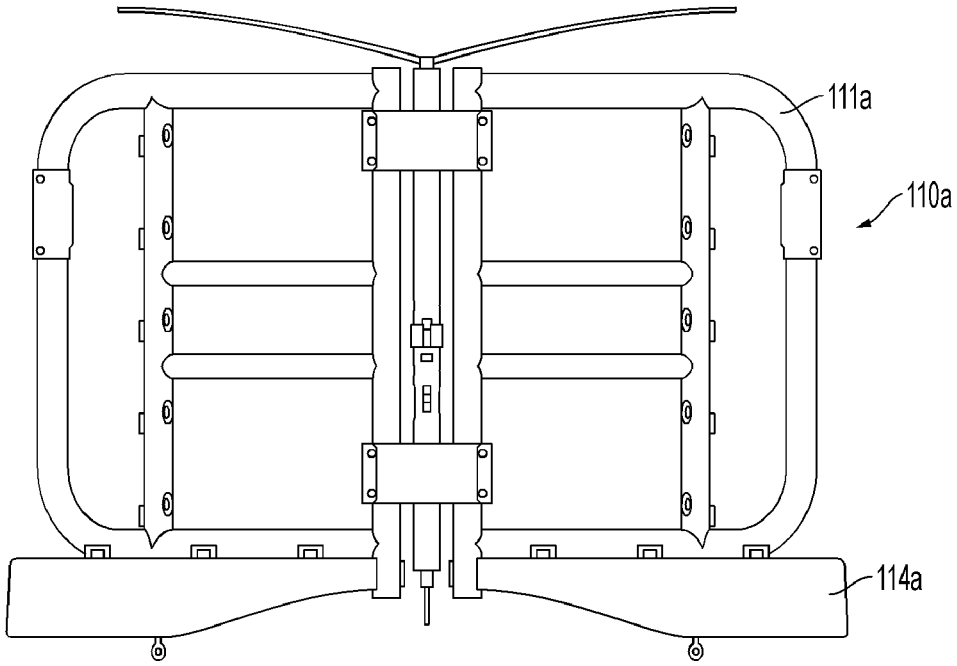

Exemplary retractable and expandable marine barriers usable in embodiments of the disclosed marine barrier gate will first be described in detail with reference to FIGS. 1A through 5. As shown in FIGS. 1A-C, a marine barrier 100 comprises a first plurality of substantially vertical panels 110 assembled to form a zig-zag shaped (i.e., pleated) barrier, each of the panels 110 having a pair of opposing sides 110R and 110L. Referring to FIGS. 2A-B, each of the panels 110 includes a frame 111 comprising metal and having a plurality of through holes 112 extending from one major surface to another major surface for allowing passage of water and wind through the panel, a plastic coating 113 encapsulating the frame 111, and an integral buoyancy portion 114 at the bottom of the frame 111. In an alternative embodiment shown in FIG. 2C, a panel 110*a* includes a buoyancy portion 114*a* that is a separate structure attached to a plastic-coated frame 111*a*.

Referring again to FIGS. 1A-B, a plurality of hinges 120 each elastically connect an outboard side of a first one of the panels 110 to a side of an adjacent second one of the panels 110 with an included angle A therebetween, to form a buoyant continuous first pleated row of panels 101, such that the outboard hinges 120 are arranged in first and second substantially parallel rows. A plurality of impact cables 130 are attached to opposing ends of the first pleated row of panels 101 and pass through each of the hinges 120 in the first row of hinges. In the embodiment shown in FIGS. 1A-C, there are five impact cables 130, and they are substantially parallel to each other. Impact cables 130 comprise, for example, conventional steel wire rope, fiber rope, or synthetic rope. The diameter of impact cables 130 is determined in a conventional manner based on the desired capacity of the system.

Referring now to FIG. 1C, when the barrier 100 is floating in a body of water 140 and a moving vessel, represented by arrow 150, impacts one or more of the impact cables 130, the impact cables 130 deflect to transfer a force of the impact to one or more of the first plurality of panels 110, which in turn engage the water 140 to transfer the force of the impact to the water 140, to arrest the motion of the vessel. The load path of the impact force of the moving vessel is shown in FIG. 1*c* by lines X, Y, and Z, representing the impact force as it moves from the impact cables 130 (line X) to the panels 110 (line Y) and the hinges 120 (lines X and Z). Thus, during an impact the panels 110 are drawn in around the point of impact and engage the water to dissipate the impact force.

Figure 3A:
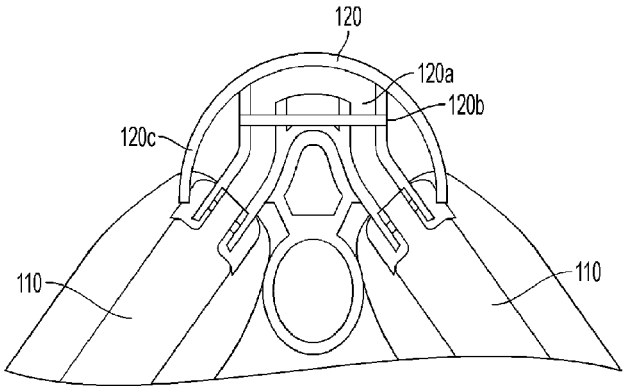
FIGS. 3A-C are views of an outboard hinge usable in embodiments of the disclosed marine barrier gate.
Figure 3B:
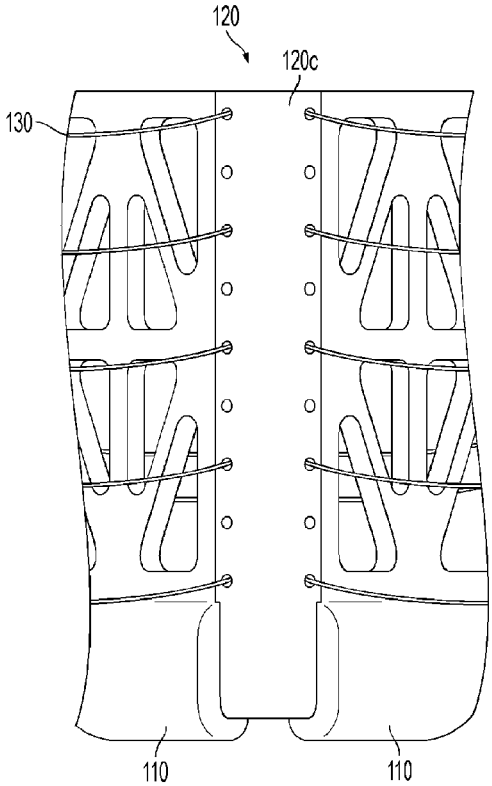
Figure 3C:
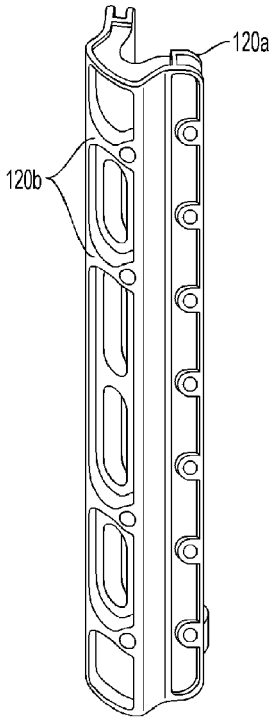

As shown in FIGS. 3A-C, outboard hinges 120 each comprise a core 120*a* of an elastic material for attaching to the side of the first one of the panels 110 and to the side of the second one of the panels 110, with the included angle A therebetween, the core 120*a* having a passageway 120*b* for the impact cables 130. An outer shell 120*c* is provided for attaching to and covering a portion of the core 120*a* proximal the passageway 120*b*, and for engaging the first and second ones of the panels 110, such that when the barrier 100 is floating in the body of water and a vessel impacts the outer shell 120*c* of one of the outboard hinges 120, the outer shell 120*c* guides the vessel into engagement with the impact cables 130. In certain embodiments, the core 120*a* comprises EPDM rubber having a Durometer value of about 60 to about 70, and the outer shell 120*c* comprises high density polyethylene.

Due to their elasticity, hinges 120 enable the panels 110 to move from an expanded position where adjacent ones of the panels 110 are disposed with the included angle A therebetween, to a retracted position where the panels 110 are substantially parallel to each other. A tow cable 160*a* is attached to an end hinge of one of the rows of hinges 120 and passes through the other hinges 120 of that row of hinges, for moving the panels 110 from the expanded position to the retracted position, as will be described in greater detail herein below. A catenary cable 160*b* also passes through the hinges 120 of that row of hinges, as will also be described in greater detail herein below. Since the disclosed barrier is retractable, it can be used as a gate; for example, to allow vessels to pass into and out of an area protected by the barrier.

Another marine barrier usable in embodiments of the disclosed marine barrier gate will now be described with reference to FIGS. 4A-E. A marine barrier 400 includes two continuous pleated rows 401, 402 of first and second respective pluralities of the panels 110, to form a diamond-shaped barrier. A plurality of the outboard hinges 120, and a plurality of inboard hinges 420 (which will be further described herein below) elastically connect opposing sides of adjacent panels 110 with the included angle A therebetween to form the continuous pleated rows 401, 402, such that the hinges 120, 420 are arranged in first, second, and third substantially parallel rows 410*a-c*. End hinges 421*a-b*, also elastic, are similar in structure to inboard hinges 420, but join only two panels 110.

A first plurality of impact cables 430 are attached to opposing ends of the first pleated row of panels 401 and pass through each of the hinges 120 in the first row of hinges 410a. A second plurality of impact cables 430 are attached to opposing ends of the second pleated row of panels 402 and pass through each of the hinges 120 in the third row of hinges 410c. In this embodiment, there are five impact cables 430 associated with each of the pleated rows 401, 402, and they are substantially parallel to each other. Impact cables 430 comprise, for example, steel wire rope.

Figure 4A:
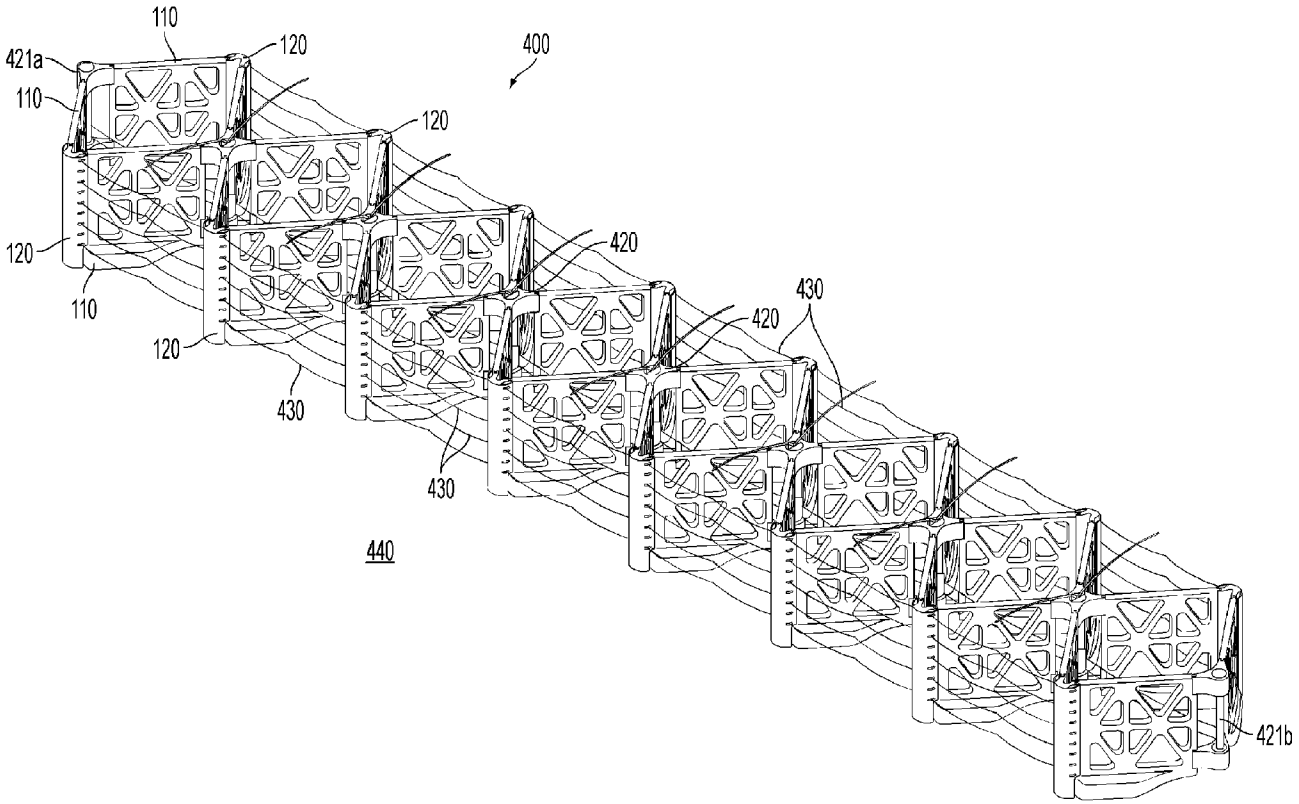
FIGS. 4A and 4E are perspective views of a barrier usable in embodiments of the disclosed marine barrier gate.
Figure 4B:
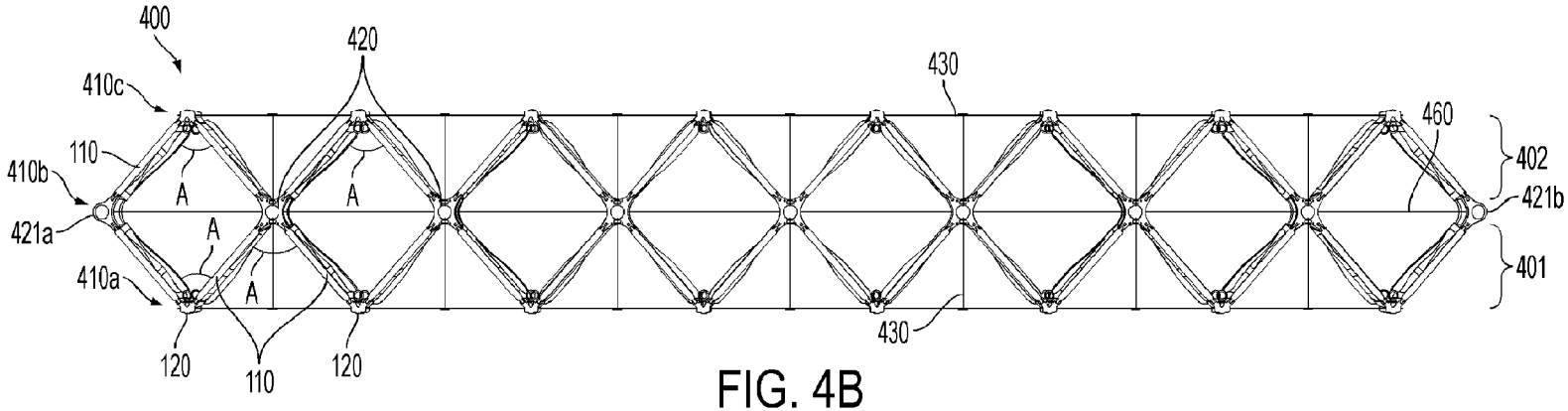
FIGS. 4B and 4D are top views of the barrier of FIG. 4A.
Figure 4C:
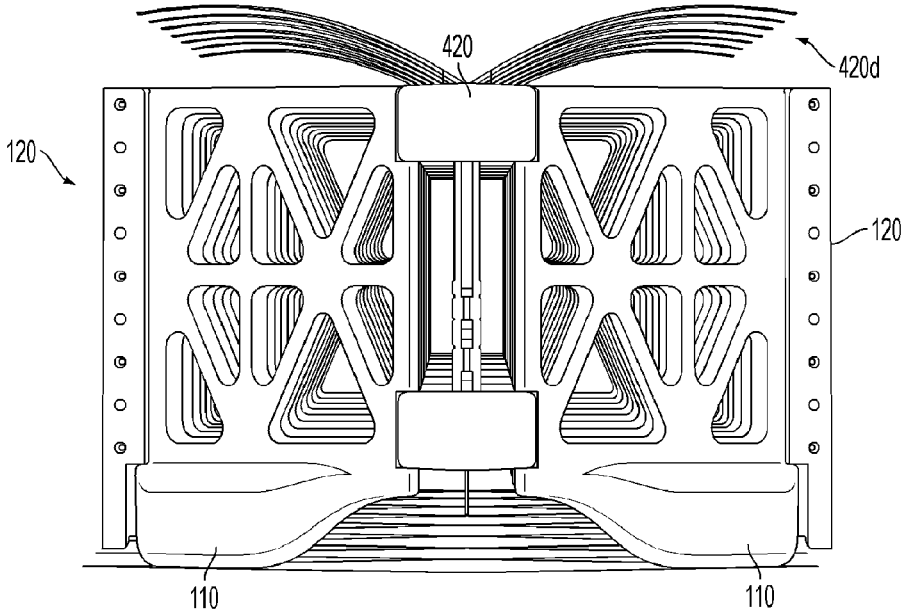
FIG. 4C is an end view of the barrier of FIG. 4A.
Figure 4D:
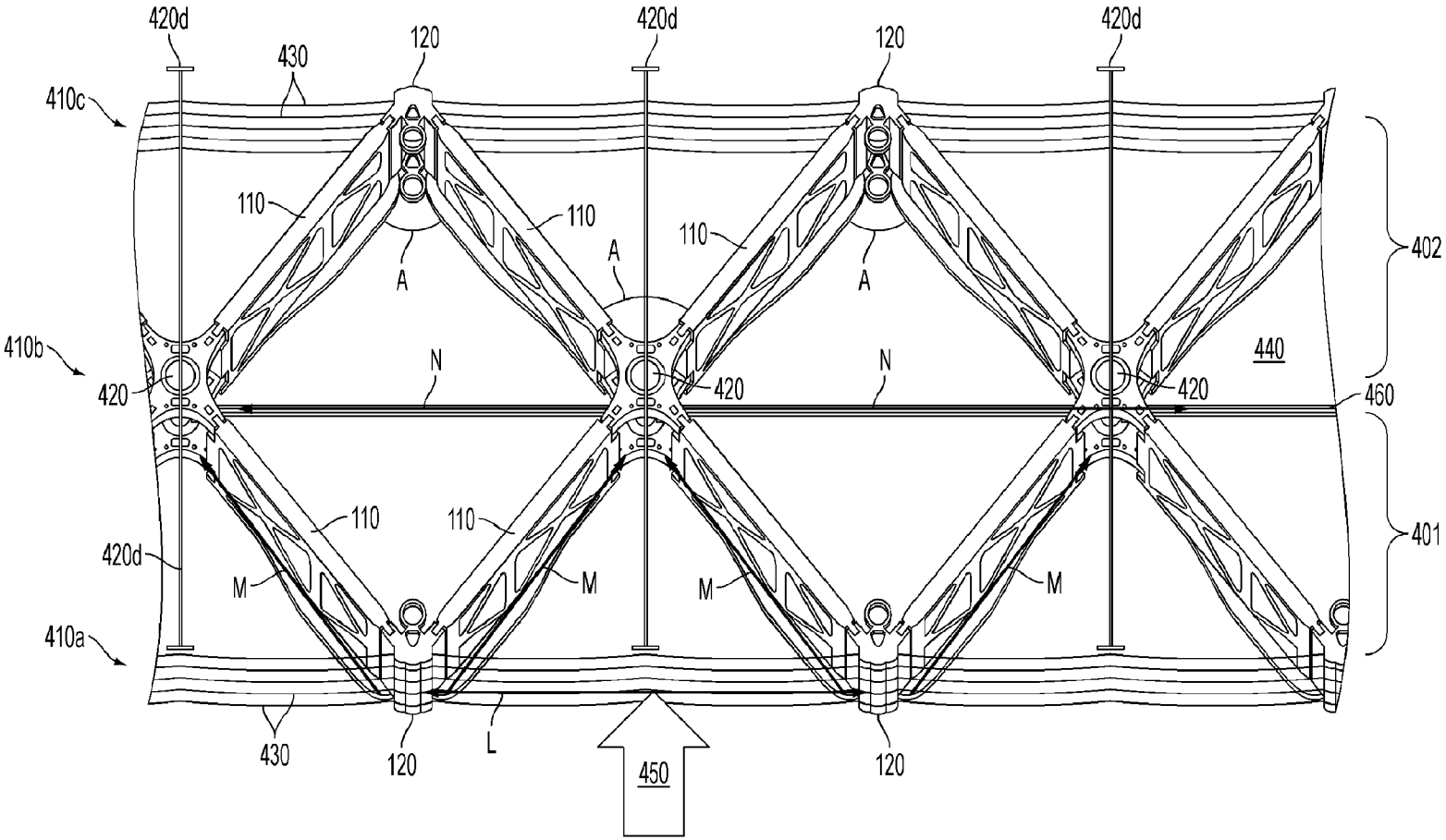
Figure 4E:
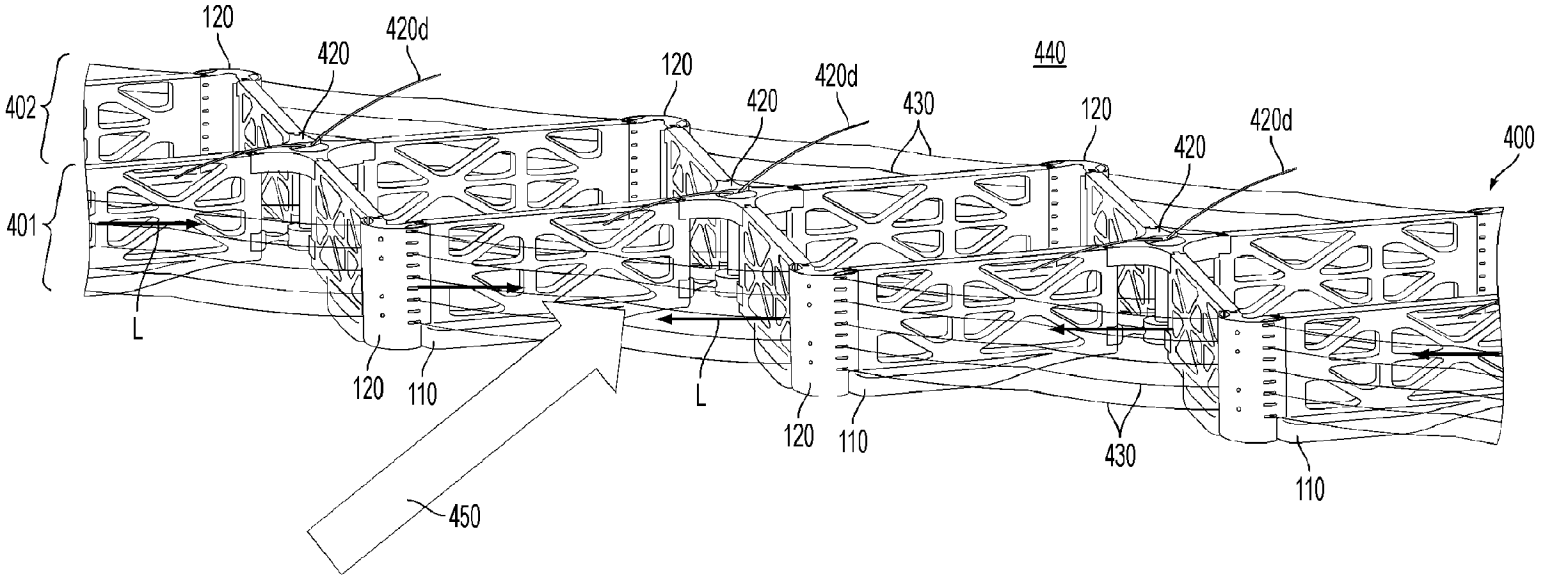

Referring now to FIGS. 4D-E, when the barrier 400 is floating in a body of water 440 and a moving vessel (represented by arrow 450) impacts one or more of the first plurality of impact cables 430 attached to the first pleated row 401 of panels 110, the impact cables 430 deflect to transfer a force of the impact to one or more of the first plurality of panels 110 of the first pleated row 401, which in turn engage the water 440, and to one or more of the second plurality of panels of the second pleated row 402, which in turn engage the water 440, to transfer the force of the impact to the water 440 and arrest the motion of the vessel. The load path of the impact force of the moving vessel is shown in FIGS. 4D-E by lines L, M, and N, representing the impact force as it moves from the impact cables 130 (lines L) to the panels 110 (lines M) and the hinges 120 and 420 (lines L and N).

Likewise, if a vessel impacts one or more of the second plurality of impact cables 430 attached to the second pleated row 402, the load path of the impact force will be similar, but in an opposite direction to lines L, M, N. shown in FIGS. 4D-E. Thus, during an impact the panels 110 are drawn in around the point of impact and engage the water to dissipate the impact force.

Figure 5:
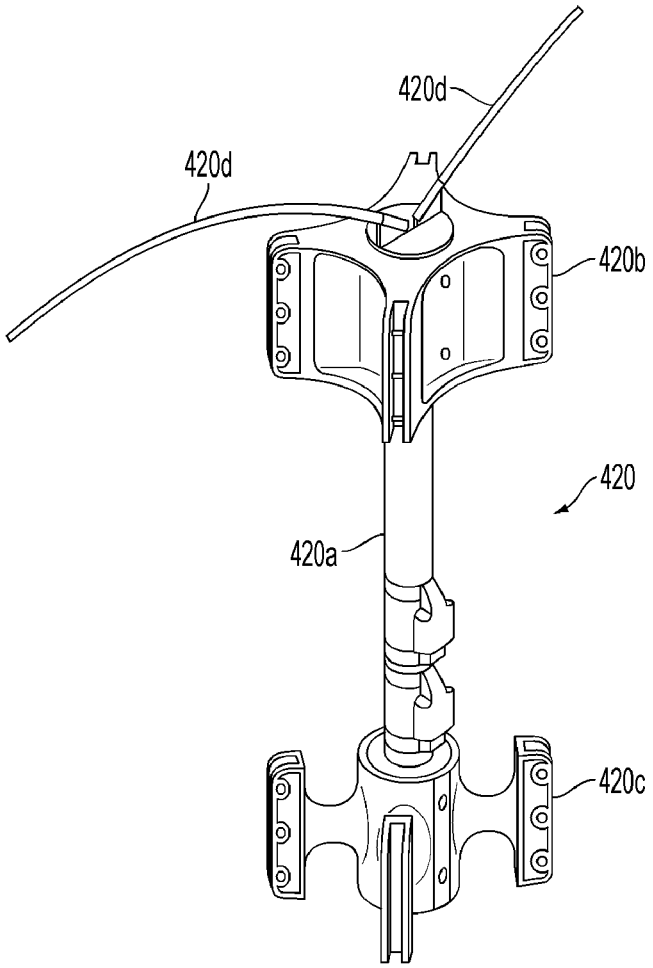
FIG. 5 depicts an inboard hinge usable in embodiments of the disclosed marine barrier gate.

Inboard hinges 420 will now be described with reference to FIG. 5. Each inboard hinge 420 is for joining four panels 110 together, and includes a vertical metal column 420*a* and a plurality of ligaments 420*b*, 420*c* attached to the column 420*a*, as by bolts. Each ligament 420*b*, 420*c* is for attaching to a side of each of four of the panels 110. For example, column 420*a* is a 5086 aluminum column with a marine coating (more specifically, a 12-inch or 6-inch Schedule 40 pipe). Ligaments 420*b*, 420*c* comprise EDPM rubber. The top ligament 420*b* has a whip 420*d* for engaging one or more of the impact cables 430 between two of the outboard hinges 120 of a row 410*a, c* of outboard hinges 120 to support the impact cable(s). Whips 420*d* perform cable management functions such as keeping cables 430 out of the water when the barrier is being assembled or is in its retracted position, and put a slight tension on cables 430 to prevent sagging and tangling. End hinges 421*a-b* are of the same construction as inboard hinges 420, but their ligaments are for attaching to a side of each of only two panels 110 (see FIGS. 4A and 4B).

Like the outboard hinges 120, inboard hinges 420 are elastic to enable the panels 110 to move from an expanded position where adjacent ones of the panels 110 are disposed with the included angle A therebetween, to a retracted position where the panels 110 are substantially parallel to each other. One or more cables 460 pass through the hinges of the row of inboard hinges 420, acting as either catenary or tow cable(s) for moving the panels 110 from the expanded position to the retracted position and vice versa, as explained in detail herein below. In one example, the barrier 400 using the panels 110 of FIG. 2A is about 30 meters long in the expanded position shown in FIG. 4A, with a height of about 2.4 meters, a beam of 4.7 meters, and a draft of 0.35 meters; barrier 400 weighs about 7700 Kg.

Figure 6:
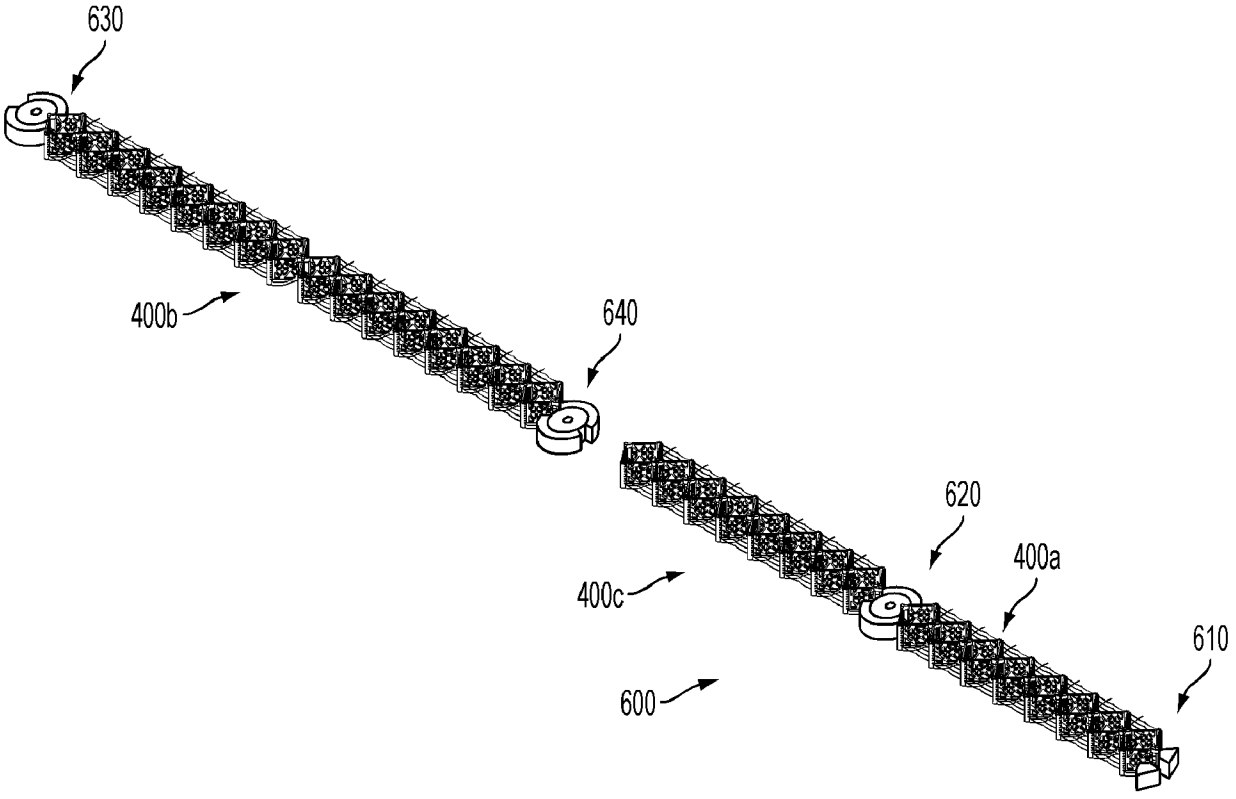
FIG. 6 illustrates a marine barrier gate according to an embodiment of the present disclosure.

A marine barrier gate according to the disclosure, and using an expandable/retractable barrier according to FIGS. 1-5, will now be described with reference to FIGS. 6 to 71. As shown in FIG. 6, a marine barrier gate 600 includes a pier mount 610 and a stationary transition buoy 620, between which is attached a barrier 400*a* of the type shown in FIGS. 4A-E as barrier 400. Barrier 400*a* is attached to pier mount 610 and transition buoy 620 by its end hinges 421, and is "static" insofar as it normally remains attached to pier mount 610 and buoy 620. Similarly, another marine barrier 400*b* of the type shown as reference numeral 400 extends between a stationary end buoy 630 and a stationary gate buoy 640 and is statically attached to buoys 630, 640 by its end hinges 421. Buoys 620 and 640, also called "automation buoys," are for performing several tasks related to opening and closing marine barrier gate 600, typically by remote control. They include conventional equipment such as winches, power systems, hydraulics, latches, and a berth for a remote operated vehicle (ROV), as necessary. This equipment will be described in detail herein below.

A movable barrier 400*c* (also of the type shown as reference numeral 400) extends between transition buoy 620 and gate buoy 640. Barrier 400*c* is attached by one of its end hinges 421 to transition buoy 620, and is expandable and retractable between buoys 620 and 640 by a methodology and apparatus that will now be described with reference to FIGS. 7A-7I.

Figure 7A:
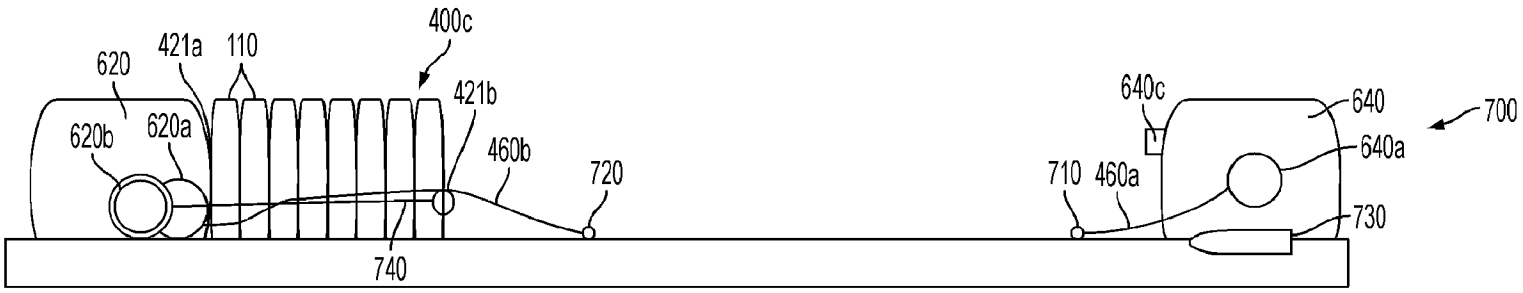
FIGS. 7A-I illustrate a marine barrier gate according to an embodiment of the present disclosure, and its operation.

As shown in FIG. 7A, in one embodiment the disclosed marine barrier gate 700 comprises a substantially stationary first buoy, such as transition buoy 620, attached to a first end hinge 421*a* of the second row of hinges 410*b* (as best seen in FIG. 4B) of a barrier 400 such as barrier 400*c* of FIG. 6. A substantially stationary second buoy, such as gate buoy 640, is disposed remote from the barrier 400*c* when its panels 110 are in the retracted position, the second buoy 640 having a first tow winch 640*a* with a first tow cable 460*a* extendible to, and attachable to, a second end hinge 421*b* of the second row of hinges 410*b* opposite the first end hinge 421*a*, for moving the panels 110 from the retracted position shown in FIG. 7A to the expanded position shown in FIG. 7G by operation of the first tow winch 640*a*. The free end of the first tow cable 460*a* has a float 710.

The first buoy 620 comprises a catenary winch 620*a* with a catenary cable 460*b* that passes through the hinges 420 of the second row of hinges 410*b* (see, e.g., cables 460 of FIGS. 4B and 4D) so it is movably engagable with the first and second pleated rows of panels 401, 402 and extendible and attachable to the second buoy 640. The free end of the catenary cable 460*b* has a float 720.

The winches described herein mounted to buoys 620, 640 are readily-available conventional winches known to those of skill in the art, and are remotely operated in a well-known manner, to eliminate the need for human labor, thereby reducing costs and danger to personnel.

The marine barrier gate further comprises a remote operated vehicle (ROV) 730 for capturing the float 710 and transporting the free end of the first tow cable 460*a* from the second buoy 640 to the barrier 400*c* for attachment to its second end hinge 421*b*, and for capturing the float 720 and transporting the free end of the catenary cable 460*b* to the second buoy 640 for attachment to the second buoy 640, when the barrier 400*c* is in the retracted position. ROV 730 is a conventional ROV, such as the "Small Unmanned Surface Vehicle" or the "E.M.I.L.Y." available from Hydranalix of Green Valley, Ariz. ROV 730 is controlled from a command and control center with pre-set commands, or is controlled by a portable command box, in a conventional manner. Use of an ROV 730 is advantageous because operating personnel are not vulnerable to attack, ROV 730 is not a hazard to navigation, and ROV's have been proven to perform well in rough environments at low cost.

In other embodiments of the disclosed gate, a manually-operated tow boat is used instead of ROV 730 to expand the barrier and transport the catenary cable 460*b*.

Figure 7B:
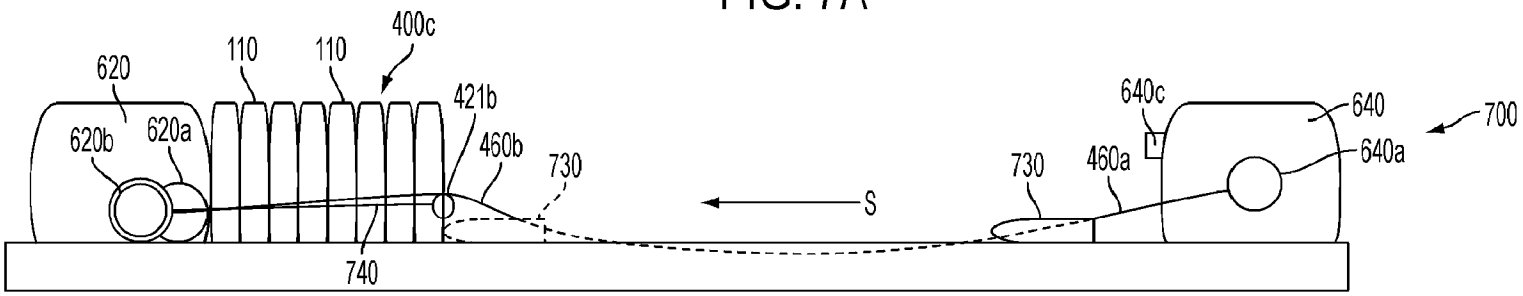
Figure 7C:
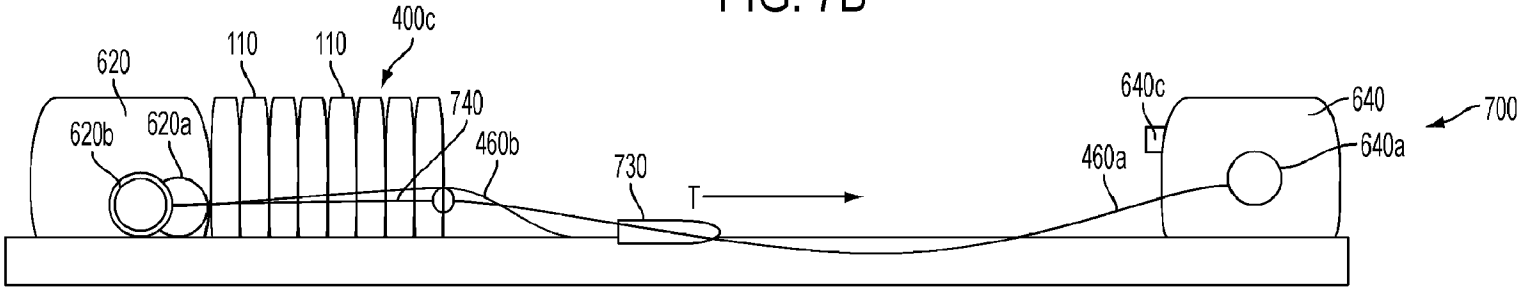
Figure 7D:
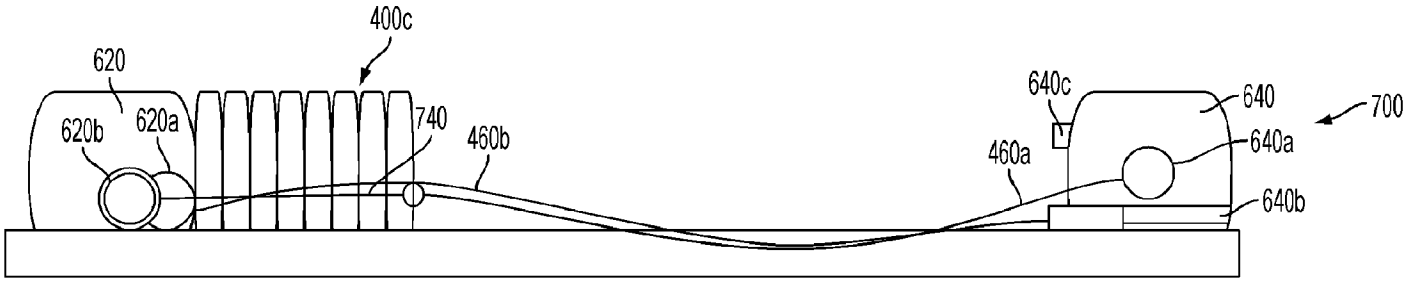

Operation of the disclosed marine barrier gate to move barrier 400*c* from the retracted position to the expanded position will now be described with reference to FIGS. 7A-G. FIG. 7A shows barrier 400*c* in the retracted position and the ROV 730 docked at the second buoy 640. The gate is ready to be expanded. In FIG. 7B, the ROV 730 undocks and captures the float 710 of the first tow cable 460*a*, spans the gate opening by moving in the direction of the arrow S towards first buoy 620 (as shown by the dashed lines) and connects the first tow cable 460*a* to the second end hinge 421*b* of barrier 400*c*. Next, as shown in FIG. 7C, the ROV 730 captures the float 720 of the catenary cable 460*b*, spans the gate opening by moving in the direction of the arrow T towards second buoy 640, and connects the catenary cable 460*b* to second buoy 640 as shown in FIG. 7D. Catenary cable 460*b* is connected to second buoy 640 in a conventional manner, such as by locking into a set of hydraulic jaws 640*b* on second buoy 640 that act as a latch for catenary cable 460*b*. The ROV 730 then redocks.

Figure 7E:
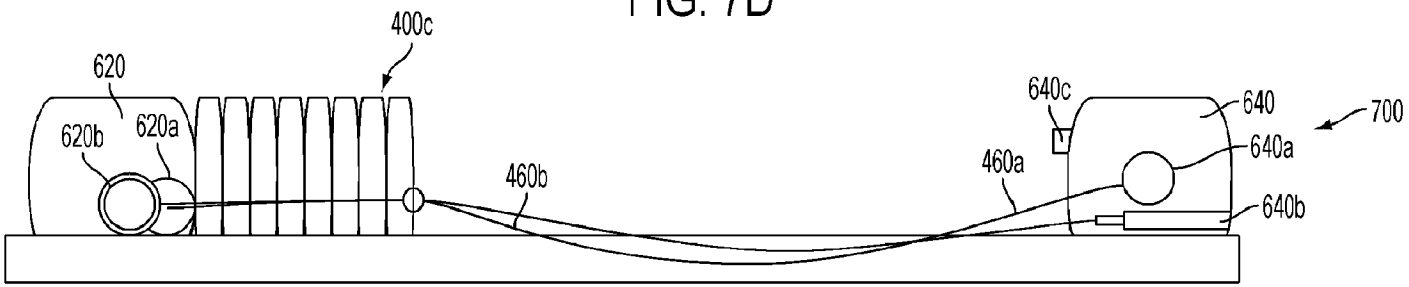
Figure 7F:
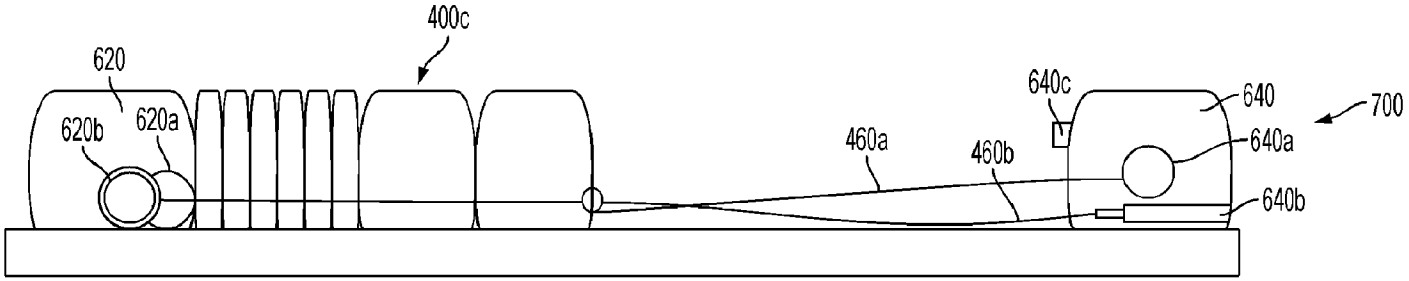
Figure 7G:
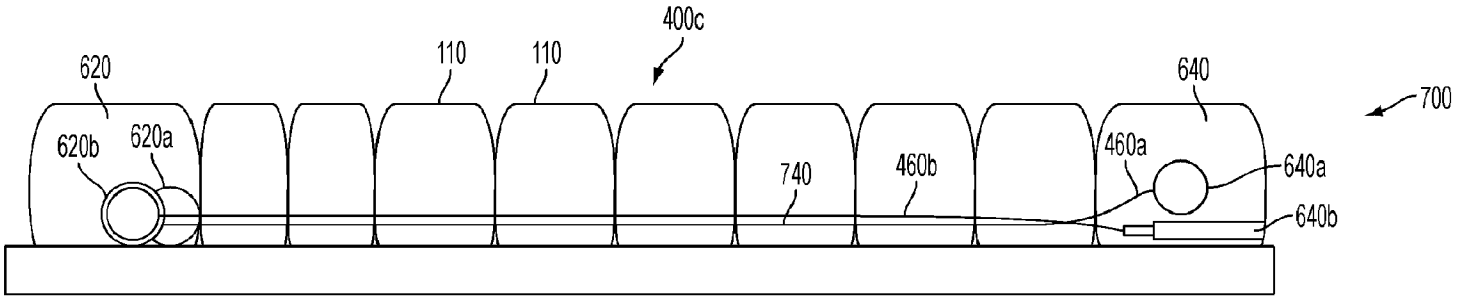
Figure 7H:
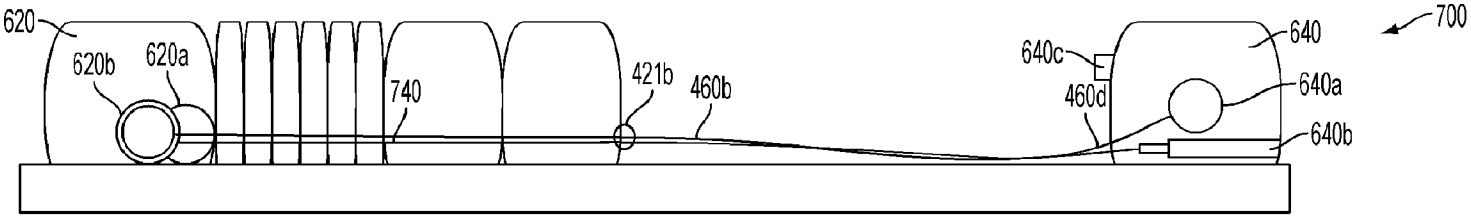

As shown in FIG. 7E, the catenary cable 460*b* is thereafter reeled in to catenary winch 620*a* to a desired tension or length, so it will absorb catenary loads on the barrier 400*c* when the panels 110 are moved from the retracted position to the expanded position. The first tow cable 460*a* is then reeled in to first tow winch 640*a* to pull the barrier 400*c* across the gate span (see FIG. 7F). The second buoy 640 comprises a latch 640*c* for engaging the second end hinge 421*b* to retain the barrier 400*c* in the expanded position. FIG. 7G shows the barrier 400*c* fully expanded, and the marine barrier gate 700 thereby closed.

Next, an apparatus and method for opening the marine barrier gate 700 will be described with reference to FIGS. 7A-I. The first buoy 620 has a second tow winch 620*b* with a second tow cable 740, which passes through the hinges 420 of the second row of hinges 410*b* and is attached to the second end hinge 421*b*, for moving the panels 110 from the expanded position shown in FIG. 7G to the retracted position of FIG. 7I by operation of the second tow winch 620*b*.

When the barrier 400*c* is in the expanded position of FIG. 7G and it is desired to move it to the retracted position, the latch 640*c* of the second buoy 640 is disengaged from the second end hinge 421*b* of barrier 400*c*, and the first tow cable 460*a* is detached from the second end hinge 421*b*. Note the catenary cable 460*b* remains attached to the second buoy 640. The second tow cable 740 is then reeled in to the second tow winch 620*b* (see FIG. 7H), while the catenary winch 620*a* maintains a length or tension of the catenary cable 460*b* such that the catenary cable 460*b* absorbs catenary loads on the barrier 400*c* when the panels 110 are moved from the expanded position to the retracted position by operation of the second tow winch 620*b*.

Figure 7I:
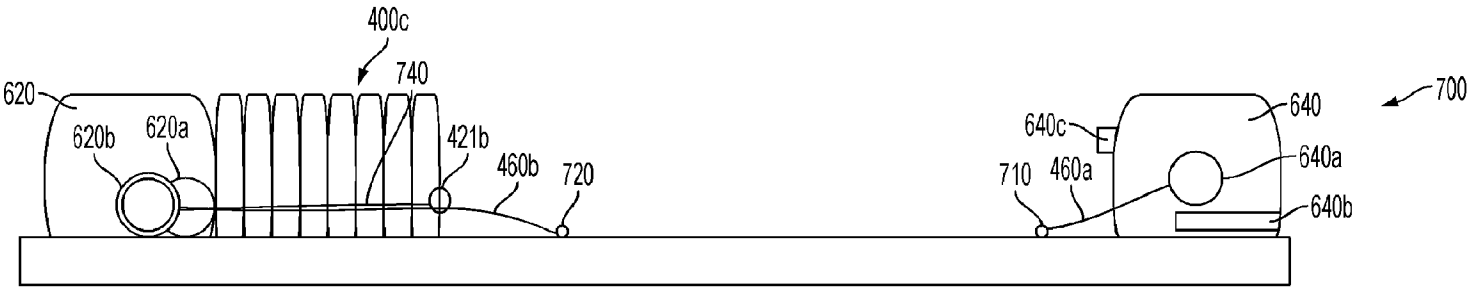

As shown in FIG. 7I, after the barrier 400*c* is retracted by operation of the second tow winch 620*b*, the latch 640*b* releases the free end of the catenary cable 460*b*, and the catenary winch 620*a* reels in the catenary cable 460*b*. The gate 700 is now open, and vessels can pass between the buoys 620, 640. Further, the gate 700 is reset and ready to be closed again when necessary.

Another embodiment of the disclosed marine barrier gate will now be described with reference to FIGS. 8A-F. The marine barrier gate 800 of this embodiment is identical to that of the gate 700 of FIGS. 7A-I, except that the first tow cable and the catenary cable are respectively permanently attached to the barrier 400*c* and the second buoy 640, and are long enough to be submersible. When the gate 800 is open these cables sit on the sea floor, and when the gate is to be closed the cables rise and come under tension (by operation of their respective winches) to expand and close the gate without an ROV or a manned tow boat. To open the gate, the barrier 400*c* is pulled along the catenary cable, and when the gate is fully retracted, the cable tension is released by the winches and the two cables drop to the seafloor under their own weight, allowing unhindered vessel passage through the gate and over the submerged cables.

Figure 8A:
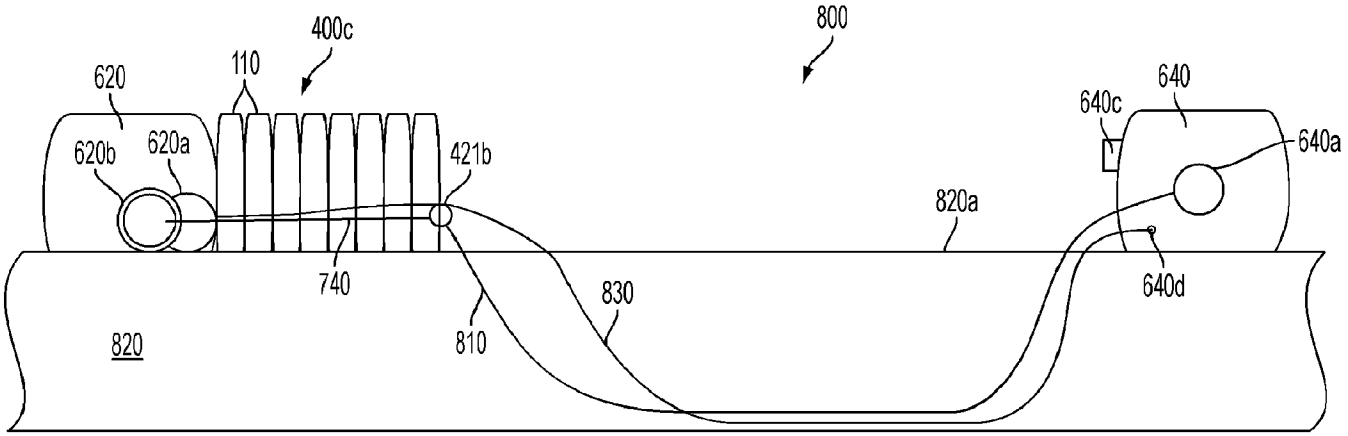
FIGS. 8A-F illustrate a marine barrier gate according to another embodiment of the present disclosure, and its operation.

As shown in FIG. 8A, a submersible tow cable 810 is fixedly attached to the second end hinge 421*b* of the second row of hinges 410*b* of barrier 400*c*, and is extendible by the first tow winch 640*a* to a position below a surface 820*a* of body of water 820 when the panels 110 of barrier 400*c* are in the retracted position; i.e., when the gate 800 is open. A submersible catenary cable 830 is fixedly attached to the second buoy 640 at attachment point 640*d*, and is extendible by the catenary winch 620*a* to a position below the surface 820*a* of the body of water 820 when the panels 110 of barrier 400*c* are in the retracted position. Thus, when gate 800 is open, vessels can pass unhindered through the gate 800.

Figure 8B:
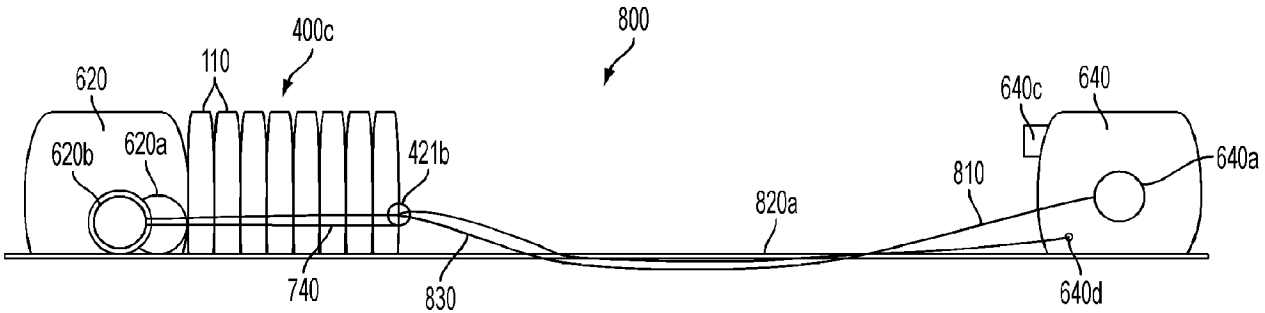
Figure 8C:
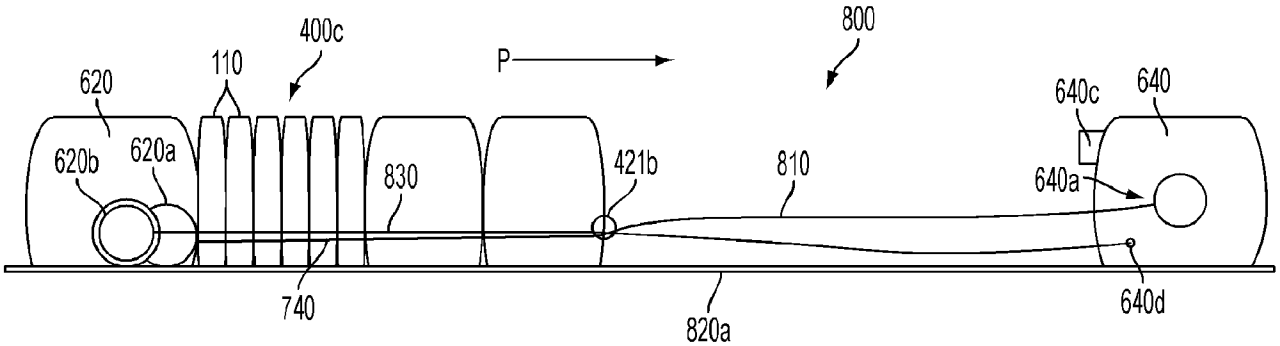
Figure 8D:
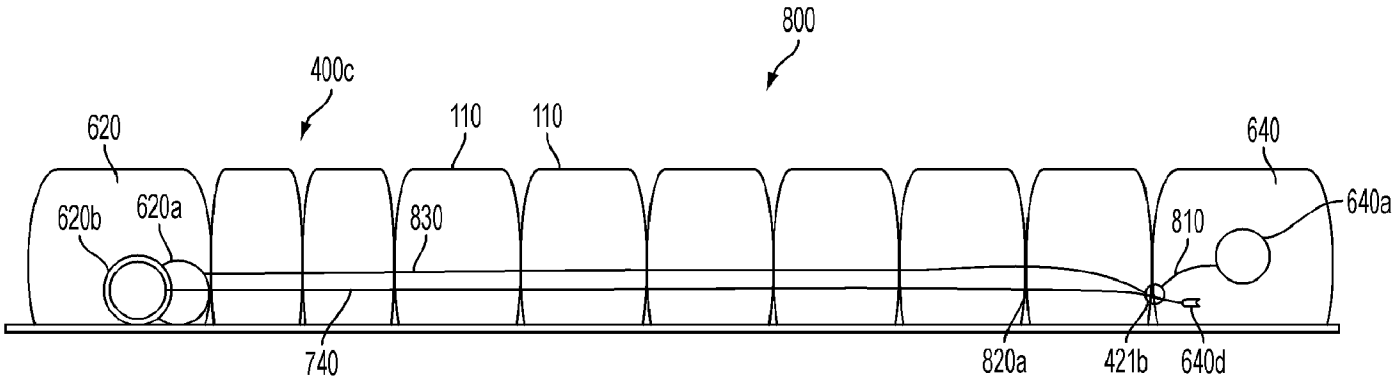
Figure 8E:
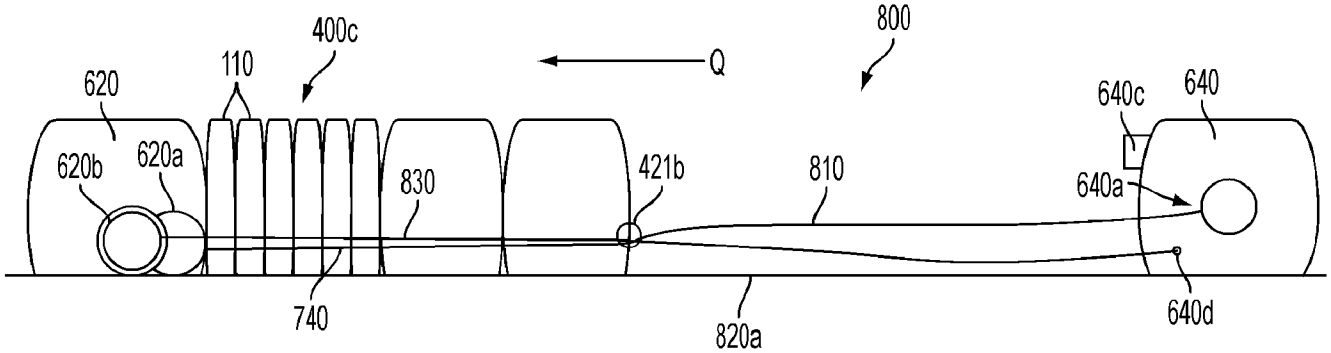

As shown in FIGS. 8B-C, when the gate 800 is to be closed the submersible catenary cable 830 is reeled in by catenary winch 620*a* to a desired tension or length, so it will absorb catenary loads on the barrier 400*c* when the panels 110 are moved from the retracted position to the expanded position. The submersible tow cable 810 is then reeled in by first tow winch 640*a* to pull the barrier 400*c* across the gate span in the direction of arrow P (see FIG. 8C). The latch 640*c* of the second buoy 640 engages the second end hinge 421*b* to retain the barrier 400*c* in the expanded position. FIG. 8D shows the barrier 400*c* fully expanded, and the marine barrier gate 800 thereby closed.

When the barrier 400*c* is in the expanded position of FIG. 8D and it is desired to move it to the retracted position, the latch 640*c* of the second buoy 640 is disengaged from the second end hinge 421*b* of barrier 400*c*. The second tow cable 740 is then reeled onto the second tow winch 620*b* (see FIG. 8E), while the first tow winch 640*a* extends the submersible tow cable 810 to allow the second tow cable 740 to move the panels 110 from the expanded position to the retracted position in the direction of arrow Q. Meanwhile, the catenary winch 620*a* maintains a length or tension of the submersible catenary cable 830 such that the submersible catenary cable 830 absorbs catenary loads on the barrier 400*c* when the panels 110 are moved from the expanded position to the retracted position by operation of the second tow winch 620*b*.

Figure 8F:
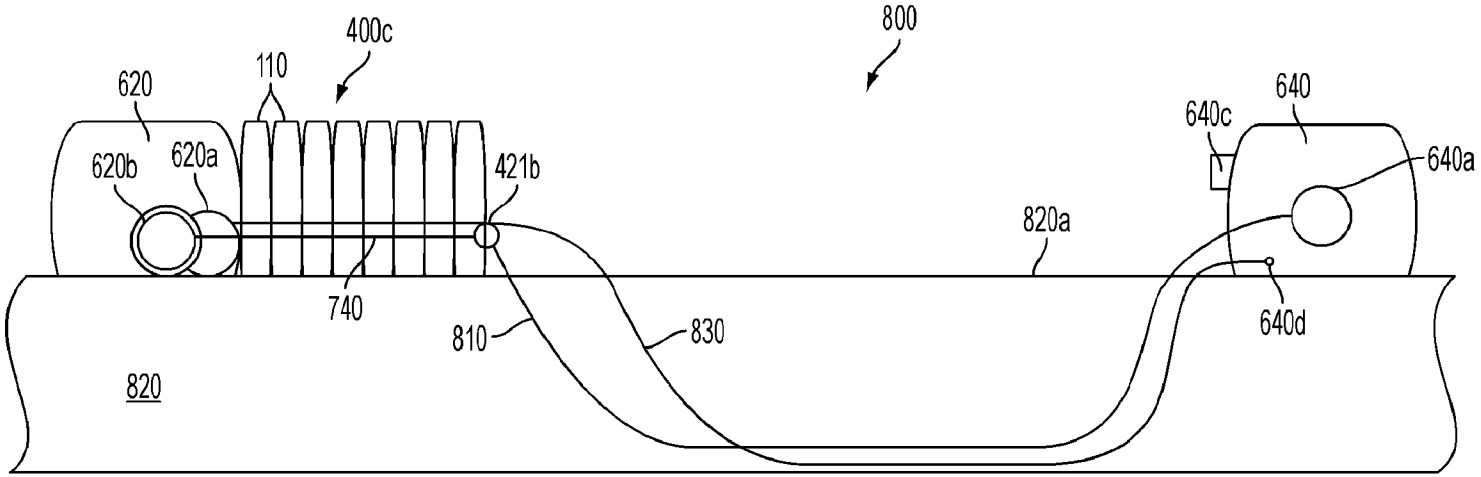

After the barrier 400*c* is retracted by operation of the second tow winch 620*b*, the first tow winch 640*a* further reels out submersible tow cable 810, which sinks under the surface 820*a* of the water 820; for example, to the sea floor. Likewise, the catenary winch 620*a* reels out submersible catenary cable 830, which sinks under the surface 820*a* under its own weight. The gate 800 is now open, as shown in FIG. 8F, and vessels can pass between the buoys 620, 640. Further, the gate 800 is reset and ready to be closed again when necessary.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A method comprising:

providing a buoyant, variable length marine barrier gate, wherein when the barrier gate is floating in a body of water, the barrier gate is movable from an expanded position where the barrier gate extends from a substantially stationary first attachment point to a substantially stationary second attachment point, to a retracted position where the barrier gate extends from the first attachment point to a location between the first and second attachment points;

attaching a proximal end of the barrier gate to the first attachment point;

extending a catenary cable, attached to the first attachment point and movably engagable with the barrier gate, from the first attachment point to the second attachment point;

attaching the catenary cable to the second attachment point;

tensioning the catenary cable when the barrier gate is in the refracted position, such that the catenary cable absorbs catenary loads on the barrier gate when the barrier gate is moved from the retracted position to the expanded position; and moving the barrier gate from the retracted position to the expanded position after the catenary cable has been tensioned.

2. The method of claim 1, comprising extending the catenary cable to the second attachment point when the barrier gate is in the retracted position.

3. The method of claim 1, wherein moving the barrier gate from the retracted position to the expanded position comprises:

extending a first tow cable, attached to the second attachment point, from the second attachment point to a free end of the barrier gate opposite the proximal end of the barrier gate;

attaching the first tow cable to the free end of the barrier gate; and drawing the first tow cable and the free end of the barrier gate towards the second attachment point.

4. The method of claim 3, comprising:

extending a second tow cable, attached to the first attachment point, from the first attachment point to the free end of the barrier gate;

attaching the second tow cable to the free end of the barrier gate;

tensioning the catenary cable when the barrier gate is in the expanded position, such that the catenary cable absorbs catenary loads on the barrier gate when the barrier gate is moved from the expanded position to the retracted position; and while the barrier gate is in the expanded position, drawing the second tow cable and the free end of the barrier gate towards the first attachment point to move the barrier gate from the expanded position to the refracted position.

5. The method of claim 4, wherein the catenary cable remains attached to the second attachment point after the barrier gate is moved to the retracted position, and the first tow cable remains attached to the free end of the barrier gate after the barrier gate is moved to the retracted position, the method comprising:

extending the catenary cable and the first tow cable to a position below a surface of the body of water when the barrier gate is in the retracted position.

6. The method of claim 4, comprising:

detaching the catenary cable from the second attachment point after the barrier gate is moved to the retracted position and drawing the catenary cable to the free end of the barrier gate; and detaching the first tow cable from the free end of the barrier gate after the barrier gate is moved to the refracted position and drawing the first tow cable to the second attachment point.

7. The method of claim 3, comprising using a vehicle to transport a free end of the first tow cable from the second attachment point to the free end of the barrier gate for attachment to the free end of the barrier gate, and to transport a free end of the catenary cable to the second attachment point for attachment to the second attachment point, when the barrier gate is in the retracted position.

8. The method of claim 7, wherein the vehicle is a remote operated vehicle.

9. The method of claim 1, comprising providing the variable length buoyant barrier gate with a first plurality of panels, each of the panels having a buoyant portion and a pair of opposing sides, and a plurality of hinges, each hinge for moveably connecting a side of a first one of the panels to a side of an adjacent second one of the panels with an included angle therebetween, to form a buoyant continuous first pleated row of panels, such that the hinges are arranged in first and second substantially parallel rows.

10. The method of claim 9, wherein a plurality of hinges of the second row of hinges are inboard hinges, each of which are also for connecting a side of an additional one of the panels to a side of an adjacent further additional one of the panels with the included angle therebetween, the method comprising:

providing a third row of hinges substantially parallel to the second row of hinges, and a second plurality of the panels, each of which has its pair of opposing sides respectively connected to hinges of the second and third row of hinges to form a second continuous pleated row of panels.

11. The method of claim 10, comprising:

providing a first plurality of impact cables, each attached to each of the hinges in the first row of hinges and extending along the length of the first pleated row of panels such that when the barrier is floating in the body of water and a moving vessel impacts one of the first plurality of impact cables, that impact cable deflects to transfer a force of the impact to one or more of the first plurality of panels, which in turn engage the water, and to one or more of the second plurality of panels, which in turn engage the water, to transfer the force of the impact to the water and arrest the motion of the vessel; and providing a second plurality of impact cables, each attached to each of the hinges in the third row of hinges and extending along the length of the second pleated row of panels such that when the barrier is floating in the body of water and a moving vessel impacts one of the second plurality of impact cables, that impact cable deflects to transfer a force of the impact to one or more of the second plurality of panels, which in turn engage the water, and to one or more of the first plurality of panels, which in turn engage the water, to transfer the force of the impact to the water and arrest the motion of the vessel.

12. The method of claim 9, comprising providing a plurality of impact cables, each attached to each of the hinges in the first row of hinges and extending along the length of the first pleated row of panels;

wherein when the barrier gate is floating in the body of water and a moving vessel impacts one of the impact cables, the impact cable deflects to transfer a force of the impact to one or more of the first plurality of panels, which in turn engage the water to transfer the force of the impact to the water, to arrest the motion of the vessel.

13. A marine barrier gate comprising:

a first plurality of panels, each of the panels having a buoyant portion and a pair of opposing sides; and a plurality of hinges, each hinge for movably connecting a side of a first one of the panels to a side of an adjacent second one of the panels with an included angle therebetween, to form a buoyant continuous first pleated row of panels, such that the hinges are arranged in first and second substantially parallel rows;

wherein when the first pleated row of panels is floating in a body of water, the panels are movable between an expanded position where the first pleated row of panels extends from a substantially stationary first attachment point, attached to a proximal end of the first pleated row of panels, to a substantially stationary second attachment point disposed remote from the first attachment point, and a retracted position where the first pleated row of panels extends from the first attachment point to a location between the first and second attachment points;

the marine barrier gate further comprising:

a first tow winch disposed at the second attachment point, the first tow winch having a first tow cable extendible to, and attachable to, a free end of the first pleated row of panels opposite the proximal end, for moving the panels from the retracted position to the expanded position by operation of the first tow winch; and a catenary winch disposed at the first attachment point, the catenary winch having a catenary cable movably engagable with the first pleated row of panels and extendible and attachable to the second attachment point;

wherein when the first pleated row of panels is in the retracted position, and the first tow cable is attached to the free end of the first pleated row of panels, and the catenary cable is attached to the second attachment point, the catenary winch is for setting a length or tension of the catenary cable such that the catenary cable absorbs catenary loads on the barrier when the panels are moved from the retracted position to the expanded position by operation of the first tow winch.

14. The marine barrier gate of claim 13, comprising a second tow winch disposed at the first attachment point, the second tow winch having a second tow cable, the second tow cable movably engaged with the first pleated row of panels and attached to the free end of the first pleated row of panels, for moving the panels from the expanded position to the retracted position by operation of the second tow winch;

wherein when the first row of panels is in the expanded position, and the catenary cable is attached to the second attachment point, the catenary winch is for setting a length or tension of the catenary cable such that the catenary cable absorbs catenary loads on the barrier when the panels are moved from the expanded position to the retracted position by operation of the second tow winch.

15. The marine barrier gate of claim 14, wherein a plurality of hinges of the second row of hinges are inboard hinges, each of which are also for connecting a side of an additional one of the panels to a side of an adjacent further additional one of the panels with the included angle therebetween, the barrier further comprising:

a third row of hinges substantially parallel to the second row of hinges; and a second plurality of the panels, each of which has its pair of opposing sides respectively connected to hinges of the second and third row of hinges to form a second continuous pleated row of panels.

16. The marine barrier gate of claim 15, further comprising a first plurality of impact cables, each attached to each of the hinges in the first row of hinges and extending along the length of the first pleated row of panels;

wherein when the barrier is floating in a body of water and a moving vessel impacts one of the first plurality of impact cables, that impact cable deflects to transfer a force of the impact to one or more of the first plurality of panels, which in turn engage the water, and to one or more of the second plurality of panels, which in turn engage the water, to transfer the force of the impact to the water, to arrest the motion of the vessel;

the barrier gate further comprising a second plurality of impact cables, each attached to each of the hinges in the third row of hinges and extending along the length of the second pleated row of panels;

wherein when the barrier is floating in the body of water and a moving vessel impacts one of the second plurality of impact cables, that impact cable deflects to transfer a force of the impact to one or more of the second plurality of panels, which in turn engage the water, and to one or more of the first plurality of panels, which in turn engage the water, to transfer the force of the impact to the water and arrest the motion of the vessel.

17. The marine barrier gate of claim 16, wherein the first plurality of impact cables are substantially parallel to each other, and the second plurality of impact cables are substantially parallel to each other.

18. The marine barrier gate of claim 15, wherein each inboard hinge comprises a vertical column comprising metal and a plurality of ligaments comprising EPDM rubber attached to the column;

wherein each ligament is for attaching to a side of each of four of the panels.

19. The marine barrier gate of claim 18, wherein one of the vertical columns has a whip for engaging one of the impact cables between two of the hinges of the first row of hinges to support the impact cable.

20. The marine barrier gate of claim 14, comprising a latch disposed at the second attachment point for engaging the free end of the first pleated row of panels after operation of the first tow winch to retain the panels in the expanded position, and for disengaging the free end of the first pleated row of panels to allow the panels to be moved from the expanded position to the refracted position by operation of the second tow winch.

21. The marine barrier gate of claim 14, comprising a latch disposed at the second attachment point for engaging and retaining a free end of the catenary cable, and for releasing the free end of the catenary cable after the panels are moved from the expanded position to the retracted position by the operation of the second tow winch.

22. The marine barrier gate of claim 13, further comprising a remote operated vehicle for transporting a free end of the first tow cable from the second attachment point to the free end of the first pleated row of panels for attachment to the free end of the first pleated row of panels, and for transporting a free end of the catenary cable to the second attachment point for attachment to the second attachment point, when the first pleated row of panels is in the retracted position.

23. The marine barrier gate of claim 22, wherein the free end of the first tow cable has a float, and the remote operated vehicle is for capturing the float prior to transporting the first tow cable; and wherein the free end of the catenary cable has a float, and the remote operated vehicle is for capturing the float prior to transporting the catenary cable.

24. The marine barrier gate of claim 13, wherein the catenary cable passes through the hinges of the second row of hinges.

25. The marine barrier gate of claim 13, further comprising a plurality of impact cables, each attached to each of the hinges in the first row of hinges and extending along the length of the first pleated row of panels;

wherein when the barrier is floating in a body of water and a moving vessel impacts one of the impact cables, the impact cable deflects to transfer a force of the impact to one or more of the first plurality of panels, which in turn engage the water to transfer the force of the impact to the water, to arrest the motion of the vessel.

26. The marine barrier gate of claim 25, wherein the impact cables are substantially parallel to each other.

27. The marine barrier gate of any one of claims 25 and 16, wherein the impact cables comprise steel wire rope, fiber rope, or synthetic rope.

28. The marine barrier gate of claim 25, wherein each of the hinges of the first row of hinges is an outboard hinge comprising:

a core of an elastic material for attaching to the side of the first one of the panels and to the side of the second one of the panels, with the included angle therebetween, the core having passageways for the impact cables; and an outer shell for attaching to and covering a portion of the core proximal the passageway, and for engaging the first and second ones of the panels, such that when the barrier is floating in the body of water and a vessel impacts the outer shell of one of the outboard hinges, the outer shell guides the vessel into engagement with the impact cables.

29. The marine barrier of claim 28, wherein the core comprises EPDM rubber having a Durometer value of about 60 to about 70, and the outer shell comprises high density polyethylene.

30. The marine barrier gate of claim 13, wherein each of the panels comprises:

a frame having a plurality of through holes extending from one major surface to another major surface for allowing passage of water through the panel:

a plastic coating encapsulating the frame; and a buoyancy portion at the bottom of the frame.

31. The marine barrier gate of claim 13, wherein the first tow cable is fixedly attached to the free end of the first pleated row of panels, and is extendible by the first tow winch to a position below a surface of the body of water when the first row of panels is in the retracted position; and wherein the catenary cable is fixedly attached to the second attachment point, and is extendible by the catenary winch to a position below a surface of the body of water when the first row of panels is in the retracted position.

32. The marine barrier gate of claim 31, comprising a second tow winch disposed at the first attachment point, the second tow winch having a second tow cable, the second tow cable movably engaged with the first pleated row of panels and attached to the free end of the first pleated row of panels, for moving the panels from the expanded position to the retracted position by operation of the second tow winch;

wherein when the first row of panels is in the expanded position, the catenary winch is for setting a length or tension of the catenary cable such that the catenary cable absorbs catenary loads on the barrier when the panels are moved from the expanded position to the retracted position by operation of the second tow winch, and the first tow winch is for extending the first tow cable to allow the second tow cable to move the panels from the expanded position to the retracted position.

33. The marine barrier gate of claim 13, wherein at least one of the first and second attachment points comprises a buoy.

34. The marine barrier gate of claim 13, wherein at least one of the first and second attachment points comprises a pier mount.

* * * * *